United States Patent [19]

Roberge

[11] 4,317,329

[45] Mar. 2, 1982

[54] PLANETARY 'SZ' TWIST ACCUMULATORS

[75] Inventor: Jean M. Roberge, Montreal, Canada

[73] Assignee: Northern Telecom Limited, Montreal, Canada

[21] Appl. No.: 188,462

[22] Filed: Sep. 18, 1980

[51] Int. Cl.[3] ..... H01B 13/04

[52] U.S. Cl. ..... 57/294

[58] Field of Search ..... 57/59, 66, 293, 294

[56] References Cited

U.S. PATENT DOCUMENTS

| | | | |
|---|---|---|---|
| 3,365,871 | 1/1968 | Schatz et al. | 57/59 |
| 3,373,549 | 3/1968 | Shaw | 57/294 |
| 3,396,525 | 8/1968 | Seeger | 57/294 X |
| 3,808,787 | 5/1974 | Vogelsberg | 57/294 |
| 4,291,527 | 9/1981 | Allard | 57/294 X |

*Primary Examiner*—John Petrakes

*Attorney, Agent, or Firm*—R. J. Austin

[57] ABSTRACT

An accumulator for twisting or stranding cable having planet gears revolving around a sun gear. Each planet gear carries an accumulator roll in a position spaced from the planet gear axis so that during rotation of the gears each accumulator roll travels alternately towards and away from the axis of the sun gear. The accumulator rolls move in synchronism and thus the accumulator capacity which is dictated by the distance between accumulator rolls, changes between maximum and minimum capacities dependent upon the accumulator roll movement. With two accumulators in series and operating with the accumulator rolls of one accumulator out of phase with the other by $\frac{1}{2}°$, an 'SZ' twist is provided.

8 Claims, 5 Drawing Figures

PLANETARY 'SZ' TWIST ACCUMULATORS

This invention relates to the twisting or stranding of lengths of filamentary material.

In the conventional methods of twisting or stranding of filamentary lengths of material, at least one accumulator of material, or two accumulators in series are used. Conventional accumulators each comprise two accumulator rolls which are disposed radially spaced-apart along the feed path of the material and with their rotational axes parallel so that their axes extend normal to the feed paths. A length of material to be stranded or twisted is fed onto the accumulator by passing the material partly around each roll and from roll to roll. The maximum length of filamentary material which may be accommodated upon an accumulator (i.e. maximum accumulator capacity) is dependent upon the roll diameters, the distance apart of the rolls, and the number of passes of material between rolls which, of course, is dependent upon the axial length of the rolls.

A conventional accumulator is caused to rotate about the feed path of the material, i.e. about a plane normal to the axial direction of the rolls, to provide a twist in the material as it enters an accumulator. When a single accumulator is used, the resultant twist, i.e. that in the material after it has left the accumulator, is a function of the material speed of the whole accumulator about the feedpath, and the entry and exit speed of the material into and from the accumulator.

It is sometimes desirable to produce what is commonly called an 'SZ' twist in lengths of material. This involves the introduction of twist in one (or 'S') direction for a certain distance, and then in the other (or 'Z') direction. The distance along each direction of twist before changing to the opposite direction, will be referred to in this specification as the "lay length". The SZ twist is found to have particular electrical advantages in twisted or stranded electrical cable or telecommunications cable. It is well known in the cable art as is exemplified in a paper "SZ Twisting and Stranding of Communications Cables Using Rotating Accumulators With Periodically Changing Capacity" by D. Vogelsberg as published in Proceedings of 20th International Wire and Cable Symposium.

It is advantageous to minimize the number of twist change-over positions from one twist direction to another and for this reason, it is desirable to have each lay length as long as is practicable. A problem exists, however, in that the lay length is dependent directly upon the accumulator capacity and this is restricted because of the design and load restrictions on the accumulator. Also the throughput speed of material is restricted for similar reasons. It is found that with the material moving in one direction from roll to roll and being simultaneously rotated about the rotational axis of the accumulator, the centrifugal force tends to cause the material to lose gripping contact with the rolls in an accumulator arrangement where the rolls move towards each other to reduce the accumulator capacity. This places a maximum speed requirement both on the rotational speed of the rolls and upon the rotational speed of the accumulator and also upon the maximum distance between rolls. In addition, with the individual rolls on one hand and the accumulator on the other hand rotating about axes normal to each other, the axial length of each roll is limited because of a gyroscopic effect and thus the number of passes of matrial between the rolls is limited.

Hence, a substantial restraint is placed upon the amount of material upon an accumulator. In addition, the gyroscopic effect makes the operation of a conventional accumulator difficult to control and substantial strain is placed upon the bearings. Further to this, one of the rolls is movable in reciprocating fashion towards and away from the other roll to change accumulator capacity. To overcome the inertia of the heavy moving parts during charge in direction of the reciprocating roll, corresponding robust moving means is required.

Similar disadvantages apply to the use of two in series accumulators. In this construction, the accumulators rotate in opposite directions and alternate in increasing and decreasing their material capacity by movement of the rolls away and towards each other.

Accordingly, the invention provides an accumulator for a twisting or stranding apparatus comprising at least two accumulator rolls which are in radial alignment, radially spaced apart, and rotatable about substantially parallel individual axes while both are rotatable together about a common accumulator axis which is substantially parallel to the individual axes with at least one of the rolls being movable around an accumulator capacity change axis spaced from and parallel to the individual axes, towards and away from the other roll to decrease and increase the capacity of the accumulator, and means to drive the rolls about the common axis to twist or strand said lengths and simultaneously to rotatably move the at least one roll towards and away from the other roll.

In its simplest form, the invention envisages the use of two accumulator rolls with one or both rolls being movable around said capacity change axis. In a case particularly where one only of the rolls is movable around the capacity change axis, this axis may be coincident with the common axis.

It is desirable, however, in a preferred arrangement to have three or more accumulator rolls for the purpose of obtaining a large differential between maximum and minimum capacities of the accumulator. Particularly when three or more rolls are used, all the rolls are preferably movable in synchronism towards and away from the other rolls to decrease and increase the capacity of the accumulator between minimum and maximum capacities. Conveniently, to effect this movement, the rolls are spaced apart around the common accumulator axis and are movable in unison around individual capacity change axes between closely spaced positions near to the accumulator axis (i.e. for minimum capacity), and widely spaced positions further from the accumulator axis. Such movement is radial with respect to the accumulator axis. Hence, with the rolls rotating about the capacity change axis, movement of the rolls outwards of the accumulator axis to increase the accumulator capacity and movement inwards of that axis to decrease the capacity occur with roll rotation in the same direction around the capacity change axis. Thus, the need to change direction of movement of a roll, such as with the reciprocating movement in a conventional accumulator, is avoided together with the need of robustly designed parts to overcome the inertia of moving parts and to impart such change in movement.

Also because the axes are all parallel and hence all the rolls rotate only in one plane of movement, then the gyroscopic effect of conventional accumulators is avoided.

In preferred constructions involving the use of three or more rolls, the means to drive the rolls comprises a sun gear and planet gears drivably connected to the sun gear, with the rolls being mounted one upon each of the planet gears. Rotation of the planet gears at a desired relative speed to the rotational speed of the sun gear moves the rolls into and out of maximum and minimum capacity positions of the accumulator at a required rate while the actual rotational speed of the sun gear controls the amount of twist given to filamentary material as it moves onto the accumulator and thus effects the final twist.

To provide twist to lengths of filamentary material, the accumulator when forming part of a twisting or stranding apparatus is disposed with the common accumulator axis disposed extending generally in the feed direction of the filamentary material.

Embodiments of the invention will now be described, by way of example, with reference to the accompanying drawings in which.

Figure 1:
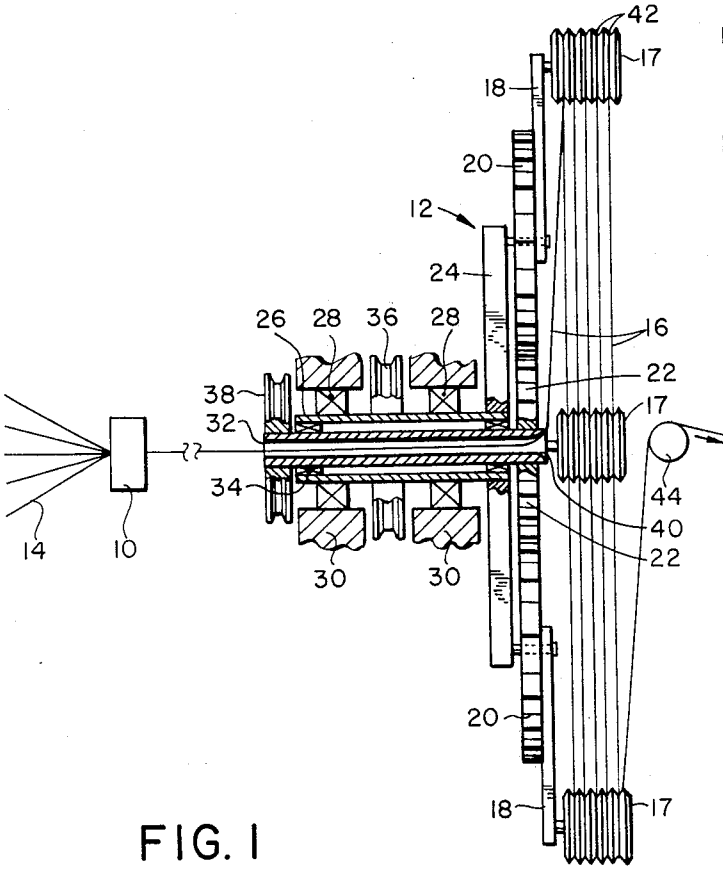
FIG. 1 is a side elevational view of a twisting or stranding apparatus.

In a first embodiment, shown generally in FIG. 1, a twisting or stranding apparatus for lengths of filamentary material comprises a nipple 10 and accumulator 12 downstream from the nipple. The nipple is of conventional design and is used to group together all of the different lengths 14 of filamentary which it is required to twist together. As will be described, the accumulator is a changing capacity accumulator for the purpose of providing "SZ" twist in the grouped lengths 16 of material while the input speed of the lengths onto the accumulator is controllably varied and the output speed is constant. The method of varying or maintaining constant the input and output speeds of material fed through the apparatus is conventional and will be discussed no further.

The apparatus of this embodiment differs from conventional apparatus in the construction of accumulator 12.

Figure 2:
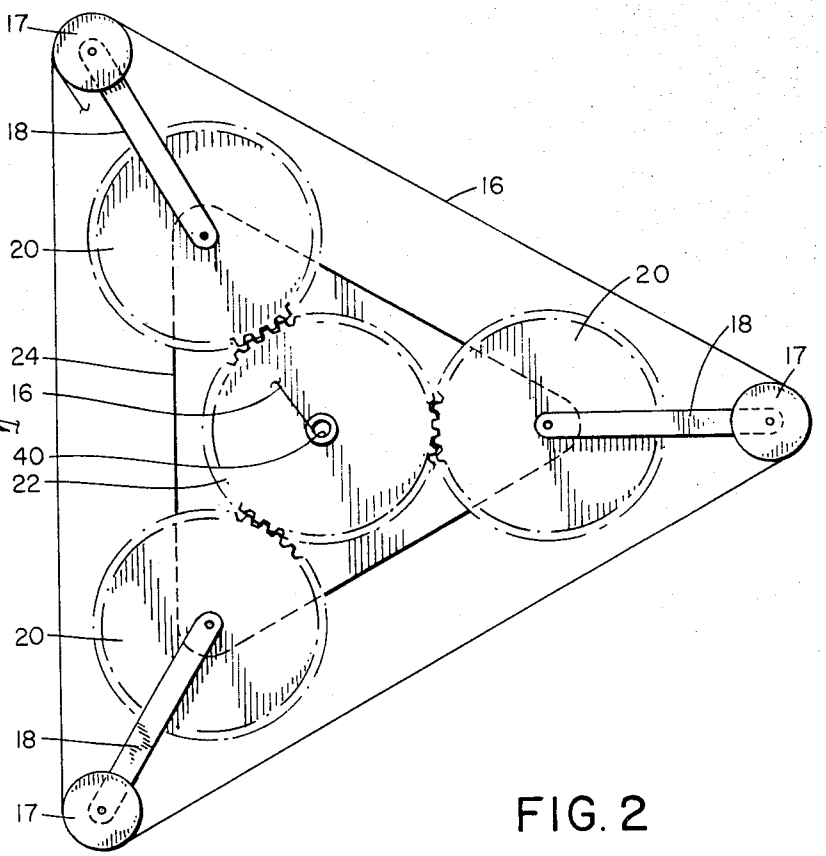
FIG. 2 is a view in the direction of arrow II in FIG. 1 showing details of an accumulator with its accumulating capacity at a maximum.

As shown by FIGS. 1 and 2, accumulator 12 comprises threeaaccumulator rolls 17, each rotatably mounted upon its individual axis at one end of an arm 18. The three arms 18 are secured by their other ends to three planet gears 20, one to each planet gear. Each arm is non-rotatable relative to its planet gear and extends radially of the planet gear to locate its roll 17 out beyond the periphery of the gear.

The three planet gears form part of a means to drive the rolls about a common accumulator axis and simultaneously to rotatably move the rolls towards and away from each other as will be described. This means also includes a sun gear 22 around which the planet gears are equally spaced apart and in driving engagement with the sun gear,the planet gears being retained in their relative positions by a trilateral planetary carrier 24 at the three corners of which the gears 22 are freely rotatably mounted.

The planetary carrier 24 is rotatable at any desired speed about an axis, coincident with the sun gear axis, i.e. about a common accumulator axis by means of a hollow driving shaft 26, to which the carrier is coaxially secured. The shaft 26 is mounted within bearings 28 within a frame 30 of the apparatus. The sun gear 22 is independently rotatable upon a separate hollow shaft 32 concentrically mounted within the shaft 26 by means of bearings 34. The two shafts are driven, respectively, by means of driving pulley wheels 36, 38 and an associated driving mechanism (not shown) by which the relative rotational speeds of the sun and planet gears may be varied as desired.

In use, the accumulator is disposed with the common accumulator axis extending along and the individual roll axes extending parallel to the general feed direction of the grouped lengths 16 of material passing through the apparatus. The lengths 16 are fed from the nipple, and along the accmulator axis through the shaft 32. Upon reaching the end of shaft 32, the lengths extend around an end 40 of the shaft, which is suitably rounded and surface treated to minimize wear upon the material by friction, and radially outwardly to the rolls 17. Each roll is formed with a plurality of spaced annular grooves 42 and the lengths 16 of material pass from one roll to another in turns around the accumulator, the adjacent turns being separated by their being contained and guided within adjacent grooves 42 as shown by FIG. 1. From the accumulator, the lengths 16 are fed around a freely rotatably guide wheel 44 before proceeding, as twisted material, to a subsequent manufacturing process (not described). The wheel 44 is suitably secured to, or relative to, the planetary carrier 24 to ensure it is permanently oriented in a fixed position relative to the final roll 17 (i.e. the lower roll in FIG. 1) around which the lengths 16 turn before proceeding to wheel 44.

With the capacity of the accumulator changing, as will now be described, the ingoing speed of the lengths 16 through shaft 26 is suitably varied (in known manner) to provide "SZ" twist in the lengths leaving the accumulator at constant velocity around the wheel 44.

Accumulator change in capacity is effected by moving the rolls 17 from innermost (FIG. 4), or closely spaced positions in which the rolls axially overlap the sun gear and lie close to its axis, to outermost or widely spaced positions (FIG. 2). The change in capacity from the minimum to the maximum as shown by those figures, is reflected by the difference in the distances between the rolls in FIGS. 2 and 4. Thus each half revolution of the planet gears 22 turns the arms 18 from the innermost positions of FIG. 4 to the outermost position of FIG. 2 by rotation around the axes of the planet gears 20, these axes thus providing the function of accumulator capacity change axes. A further half revolution of the planet gear, continuing in the same direction, returns the arms to their innermost positions.

Figure 3:
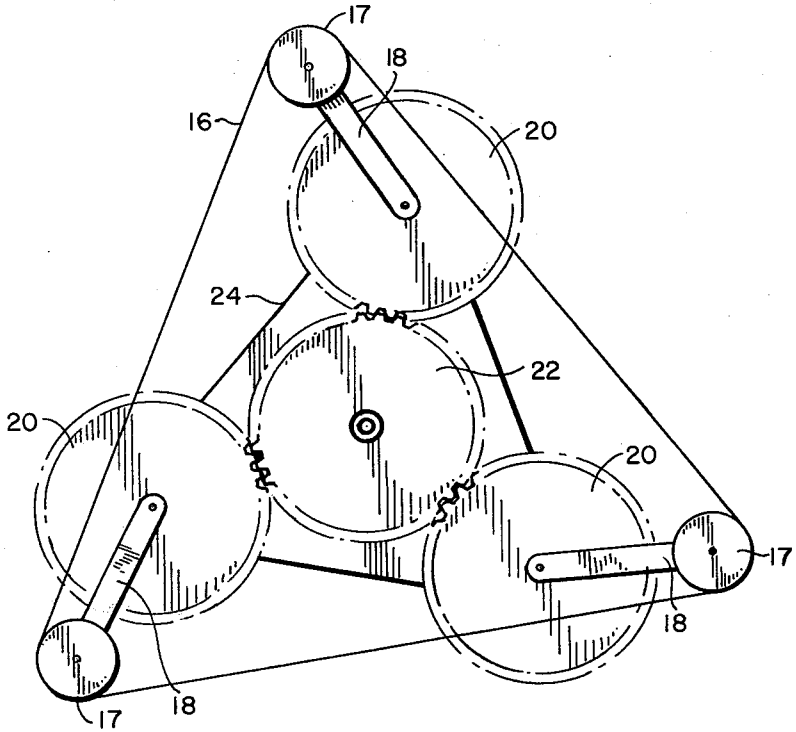

Because of the use of a planetary gear arrangement, the difference in speeds of rotation of the planetary carrier 24 and of the sun gear may be small while providing for a practically significant number of cycles between maximum and minimum accumulator capacities per minute. For instance, with the sun gear rotating clockwise at 2000 r.p.m. and the planetary carrier rotating clockwise at 2005 r.p.m., the planet gears are driven clockwise by the sun gear at 5 r.p.m. in a case where the sun gear has the same number of teeth as each planet gear, thereby giving 5 complete cycles per minute. FIG. 3 represents a position of the rolls 17 as they move towards their outer positions. With each cycle representing a complete lay length in the "S" direction and another in the "Z" direction, then this gives 10 lay lengths of material per minute. The above is merely by way of example and clearly the number of lay lengths is easily alterable by merely changing the relative speed of the sun gear and planetary carrier.

Of importance in the above construction is the fact that all parts are rotating about the same or parallel axes and a gyroscopic effect is avoided. Although there is a centrifugal effect tending to lift the lengths of material passing between rolls 16, this effect is substantially reduced compared with the combined centrifugal and gyroscopic effects in conventional accumulators. Hence, the distances between rolls 16 in their outer positions in FIG. 2 may be greater than is practicable between rolls in conventional accumulators before the filamentary material loses its frictional grip upon the rolls. Also, the gyroscopic effect in conventional accumulators imposes design restrictions upon the inertial masses thus further limiting distance between rolls and their axial length. Both of these factors while restricting maximum capacity of the accumulators are not factors which need to be considered when designing accumulators according to the above embodiment. It follows that an accumulator as described in this embodiment may have a greater capacity change than has been possible previously. Hence, greater lays are possible. Also the accumulator parts and framework need be less bulky than is normally required to accommodate the loads in conventional accumulators, especially when gyroscopic effects and the load effects of reversing direction of reciprocating rolls in capacity change accumulators is taken into account. Reversal in direction, both rotary and reciprocatory is avoided in accumulators according to the invention and as described in the first embodiment. Although the accumulator of the first embodiment changes accumulator capacity to provide 'S' and 'Z' twists, the capacity change is effected by planetary gears rotating constantly in the same direction and at constant speed.

Figure 5:
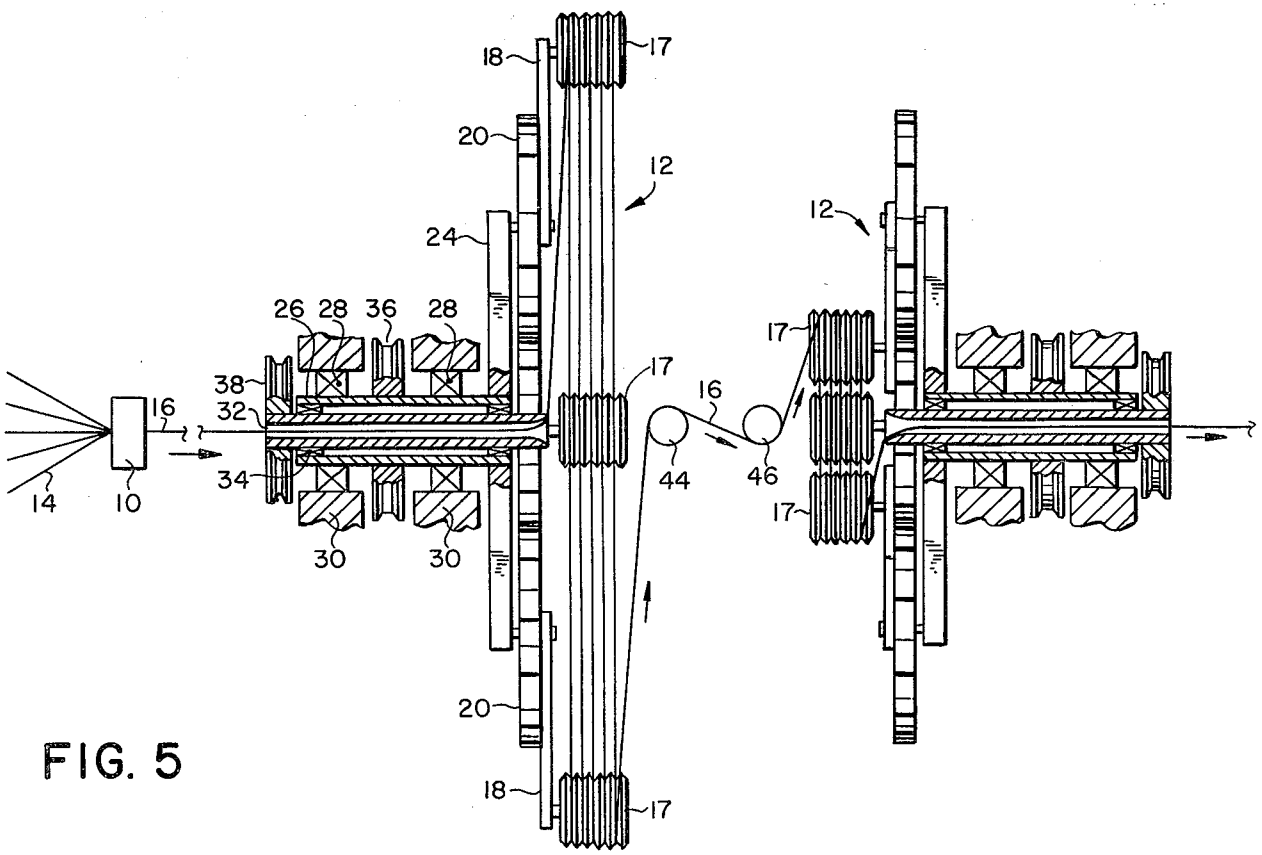
FIG. 5 is a view similar to FIG. 1 of a second embodiment.

In a second embodiment shown in FIG. 5, a twisting or stranding apparatus has two in-tandem accumulators 12 each of the same design as the accumulator in the first embodiment.

Figure 4:
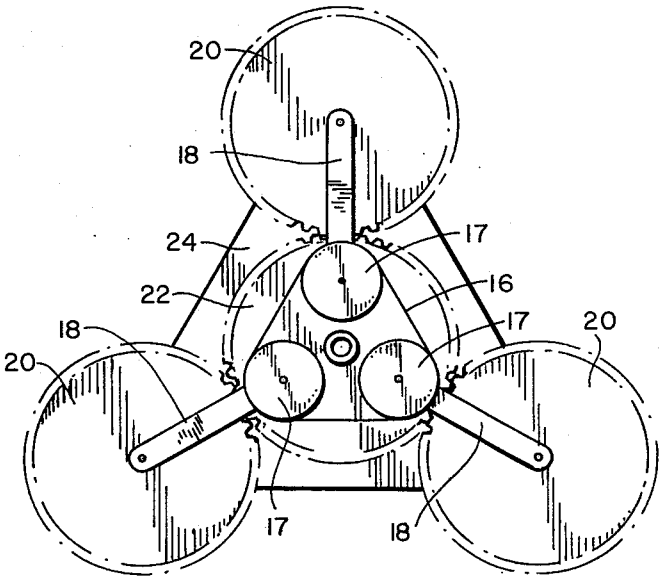
FIGS. 3 and 4 are views similar to FIG. 2 of the accumulator at times of different accumulator capacities.

In the second embodiment, the downstream accumulator is reversed in position along the feedpath and is separated from the upstream accumulator by the use of the guide wheel 44 and another guidewheel 46 to guide the lengths 16 of material onto the rolls 17 of the downstream accumulator. This apparatus, which has similar advantages to those discussed for the first embodiment, controls the 'SZ' twist lay operation by reducing the capacity of each accumulator as the other increases together with a required velocity change of the material as it moves along the feedpath between the accumulators. FIG. 4 shows the upstream accumulator in its maximum capacity position and the downstream accumulator in its minimum capacity position. Both accumulators rotate, i.e. the sun and planet gears, around the common axis at a constant speed.

In the second embodiment the inlet and outlet speeds of the lengths of material are constant as is normal in conventional apparatus employing conventional accumulators in tandem.

It is important to note that an accumulator according to the invention and as described above does not change its capacity linearly between minimum and maximum capacities. This is because the rolls 17 rotate around the centres of planet gears 20 and do not progress linearly towrds and away from the centre of sun gear 22. This results in a change in rate of charge and discharge of each accumulator. However, as two accumulators are used in tandem and 180° out of phase, then each exactly compensates for any change in rate of the other to thereby produce a constant ingoing and outgoing speed. It should be borne in mind, however, that in view of the above characteristics of the single accumulator, it cannot be used in tandem with a conventional accumulator which changes its capacity in linear fashion.

What is claimed is:

1. An accumulator for a twisting or stranding apparatus for lengths of filamentary material comprising at least two accumulator rolls which are in radial alignment, radially spaced apart and rotatable about substantially parallel individual axes while both are rotatable together about a common accumulator axis which is substantially parallel to the individual axes with at least one of the rolls being movable around an accumulator capacity change axis spaced from and parallel to the individual axes, toward and away from the other roll to decrease and increase the capacity of the accumulator, and means to drive the rolls about the common axis to twist or strand said lengths and simultaneously to rotatably move the at least one roll towards and away from the other roll.

2. A twisting or stranding apparatus for lengths of filamentary material comprising at least one accumulator according to claim 1, said accumulator being disposed across a feedpath for lengths of filamentary material to be twisted or stranded with all of said axes parallel to the general direction of the feedpath.

3. Apparatus according to claim 2, wherein there are at least three accumulator rolls and all of the rolls are movable in synchronism towards and away from the other rolls to decrease and increase the capacity of the accumulator.

4. Apparatus according to claim 3, wherein the rolls are spaced apart around the common accumulator axis and are movable around individual capacity change axes between closely spaced positions near to the common accumulator axis and widely spaced positions further from the accumulator axis.

5. Apparatus according to claim 4, wherein the means to drive the rolls about the common accumulator axis comprises a sun gear and planet gears drivably connected to the sun gear, driving means for the sun gear and driving means for rotating the planet gears around the sun gear, the accumulator rolls secured one upon each of the planet gears to rotate around their individual capacity change axes which are coincident with the axes of rotation of the planet gears.

6. Apparatus according to claim 5, wherein each accumulator roll is secured to its associated planet gear by being mounted upon an arm which is itself secured to the planet gear to locate the roll radially outwardly beyond the periphery of the planet gear, the rolls axially overlapping the sun gear in their closely spaced positions and lying radially outside the sun and planet gears in their widely spaced positions.

7. Apparatus according to claim 5, wherein the driving means for the sun gear and for the planet gears comprise two concentric drive shafts drivably connected one to the sun gear and the other to the planet gears.

8. Apparatus according to claim 5 comprising two accumulators in series along the feedpath, movement of the rolls of the accumulators being synchronized so that as the capacity of each accumulator increases, the capacity of the other accumulator decreases.

* * * * *